US007147336B1

(12) United States Patent
Chou

(10) Patent No.: US 7,147,336 B1
(45) Date of Patent: Dec. 12, 2006

(54) LIGHT AND FAN DEVICE COMBINATION

(76) Inventor: Ming Shi Chou, No. 39, Lane 69, Sijow Road, Daan Hsiang, Taichung Hsien 43953 (TW)

( * ) Notice: Subject to any disclaimer, the term of this patent is extended or adjusted under 35 U.S.C. 154(b) by 32 days.

(21) Appl. No.: 11/190,539

(22) Filed: Jul. 28, 2005

(51) Int. Cl.
*F21V 33/00* (2006.01)
*F21S 13/12* (2006.01)

(52) U.S. Cl. ..... 362/96; 362/198; 362/282

(58) Field of Classification Search ..... 362/96, 362/186, 190, 191, 198, 294, 373, 280, 282, 362/322; 416/5
See application file for complete search history.

(56) References Cited

U.S. PATENT DOCUMENTS 3,511,985 A * 5/1970 Muscovitch ..... 362/282
4,665,472 A * 5/1987 Chang ..... 362/294
4,974,126 A * 11/1990 Hwang ..... 362/96
5,422,795 A 6/1995 Liu ..... 362/96
5,602,948 A * 2/1997 Currie ..... 385/33
5,603,562 A * 2/1997 Huang ..... 362/96

* cited by examiner

*Primary Examiner*—Y. My Quach-Lee
(74) *Attorney, Agent, or Firm*—Charles E. Baxley

(57) ABSTRACT

A light and fan device combination includes a base, a stand disposed on the base, a fan device disposed on top of the stand, for generating air streams, an extension attached to the fan device, and a light device attached to the extension, for generating lights, and for preventing the light device from being affected by the fan device. The fan device includes a motor housing having an extension rotatably secured to the stand. The extension includes a socket for attaching the light device. The light device includes an upper casing and a lower casing secured together. The lower casing includes an opening for attaching a screen.

6 Claims, 7 Drawing Sheets

LIGHT AND FAN DEVICE COMBINATION

BACKGROUND OF THE INVENTION

1. Field of the Invention

The present invention relates to a light and fan device combination, and more particularly to a light and fan device combination having a light device and a fan device separated from each other for being operated properly.

2. Description of the Prior Art

Typical light devices may be provided for generating lights in order to light objects, and the conventional fan devices may be provided for generating air streams or for circulating airs in order to dissipate heat or the like.

Particularly, during the hot or summer days, the typical light devices may also generate light and heat such that the users may feel hot particularly when the typical light devices are energized or are operated.

For heat dissipating purposes, the users may have to spend additional money and to prepare a separate fan device, and disposed the fan device beside him, in order to generate air streams or to circulate airs.

U.S. Pat. No. 5,422,795 to Liu discloses one of the typical lighting fixture with an air cleaning and ventilating means, and comprises a fan device disposed above a light bulb and/or a lamp holder, for being energized to generate air streams or to circulate airs.

However, the air streams generated by the fan device may blow or flow through the light bulb and the lamp holder, and may thus blow the heat generated by the light bulb toward the users, such that hot air streams may be generated and such that the hot air streams may not be used to dissipate heat.

In addition, the air streams generated by the fan device may directly blow or flow onto the light bulb and the lamp holder, such that the dirt or the like may have a good chance to be blown and attached onto the light bulb and the lamp holder.

Furthermore, when air is blown or flown onto or through the light bulb and the lamp holder, the light bulb may have a great temperature change or drop, such that the light bulb may have a good chance to be broken.

The present invention has arisen to mitigate and/or obviate the afore-described disadvantages of the conventional light and fan device combinations.

SUMMARY OF THE INVENTION

The primary objective of the present invention is to provide a light and fan device combination including a light device and a fan device separated from each other, for allowing the light device and the fan device to be operated properly.

In accordance with one aspect of the invention, there is provided a light and fan device combination comprising a base, a stand disposed on the base, a fan device disposed on top of the stand, for generating air streams, an extension attached to the fan device, and a light device attached to the extension, for generating lights, and for preventing the light device from being affected by the fan device.

The fan device includes a motor housing having an extension extended downwardly therefrom for rotatably securing to the stand. The stand includes a channel formed therein and defined between two flaps each of which includes an orifice formed therein, for rotatably receiving the extension of the motor housing, and a fastener may be engaged through the flaps and the extension of the motor housing, and may be threaded with a lock nut, for adjustably securing the motor housing to the stand at any selected angular direction.

The base includes a recess formed therein, the stand includes a lower portion engaged in the recess of the base, and secured to the base with at least one fastener. The extension is preferably a flexible extension. The extension includes a socket provided thereon, and the light device includes a light member attached or plugged to the socket.

The light device includes an upper casing, and a reflector slidably received within the upper casing. The upper casing includes at least one groove formed therein, and a fastener slidably engaged through the groove of the upper casing and attached to the reflector, for adjusting the reflector relative to the upper casing.

The light device includes a lower casing secured to the upper casing and attached onto the extension. The lower casing includes an opening formed therein, and a screen may be engaged in the opening and secured to the lower casing and may include a number of perforations formed therein, for allowing the light generated by the light member of the light device to emit out through the perforations of the screen.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
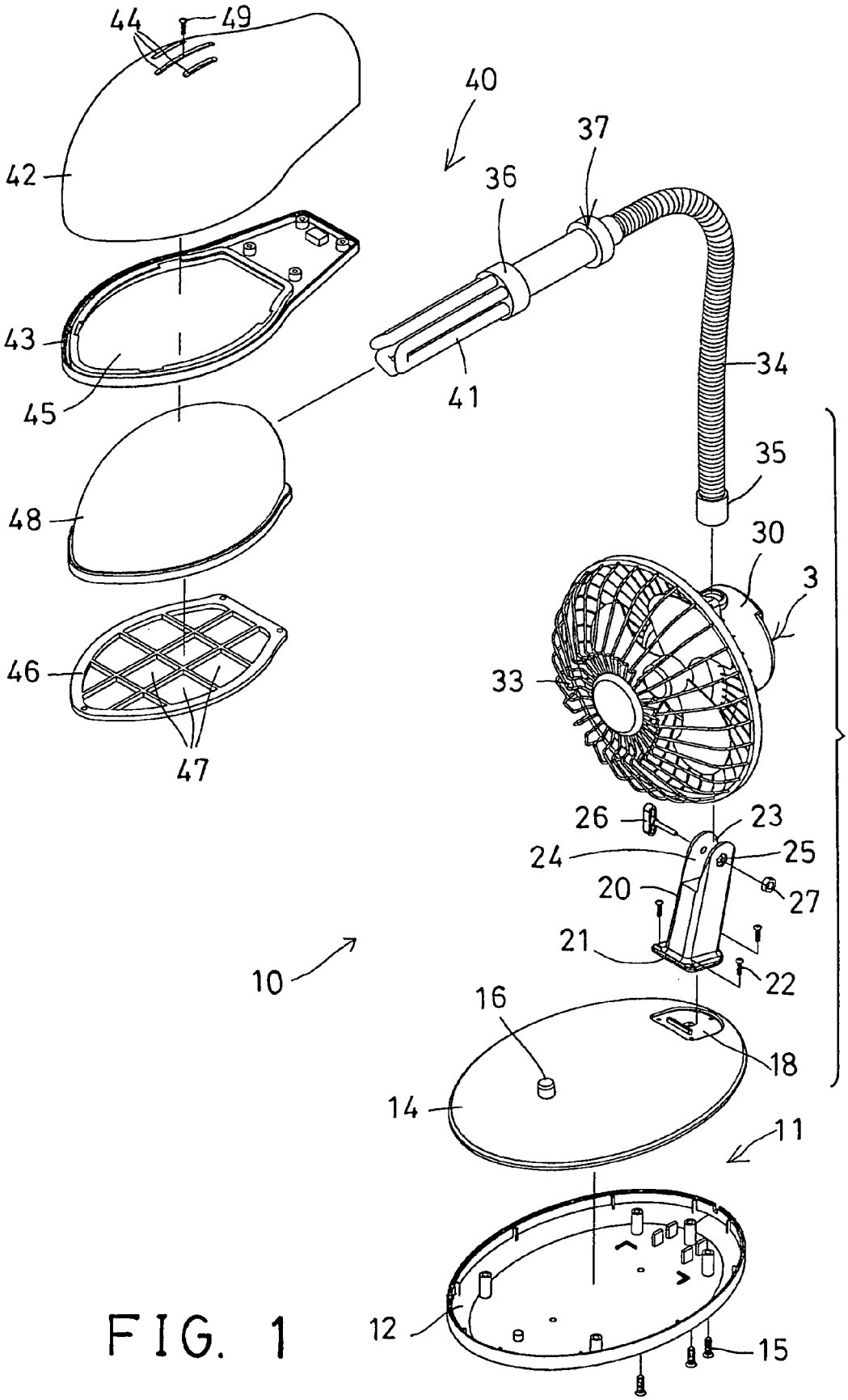
FIG. 1 is an exploded view of a light and fan device combination in accordance with the present invention.
Figure 2:
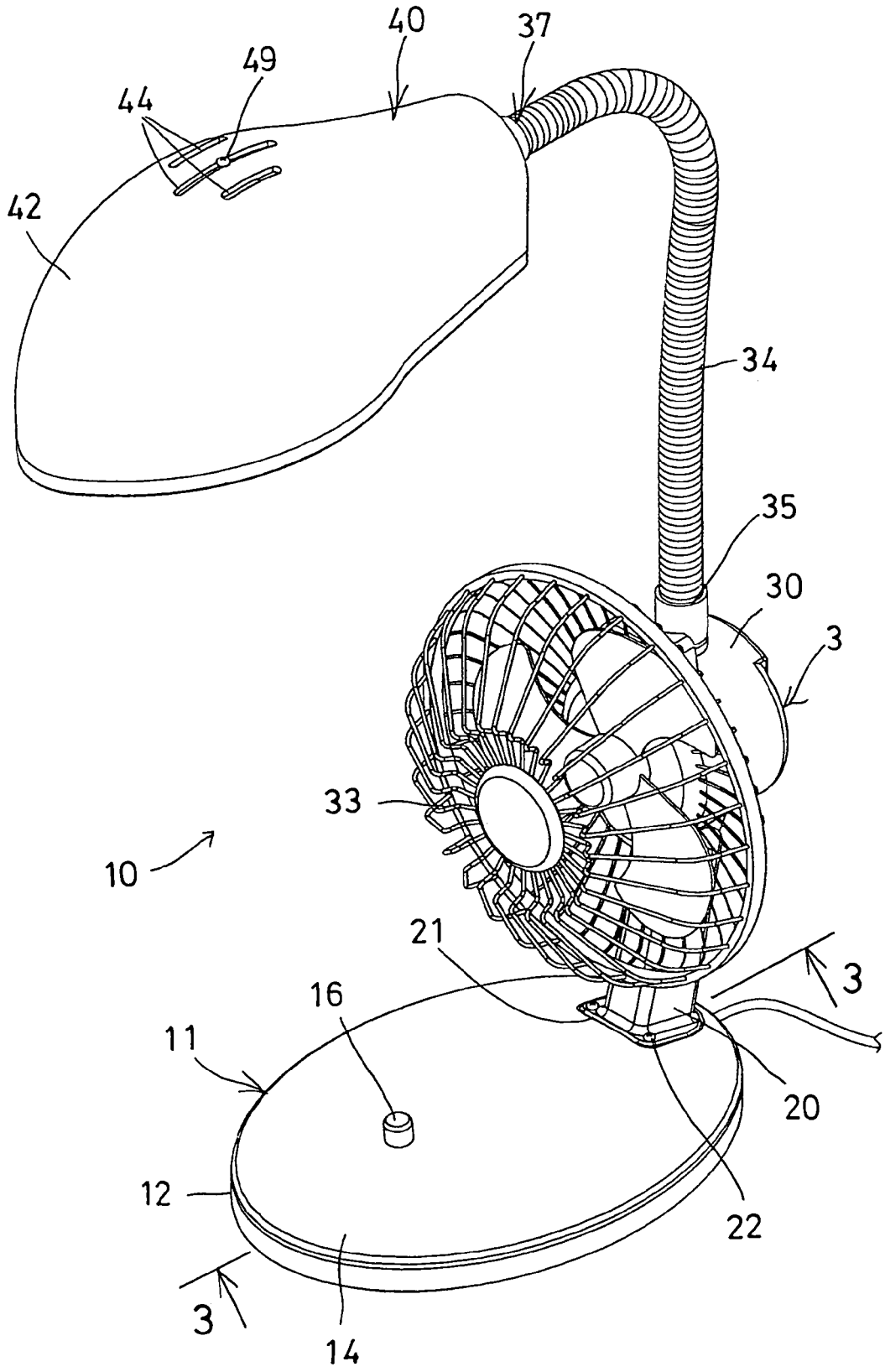
FIG. 2 is a perspective view of the light and fan device combination.
Figure 3:
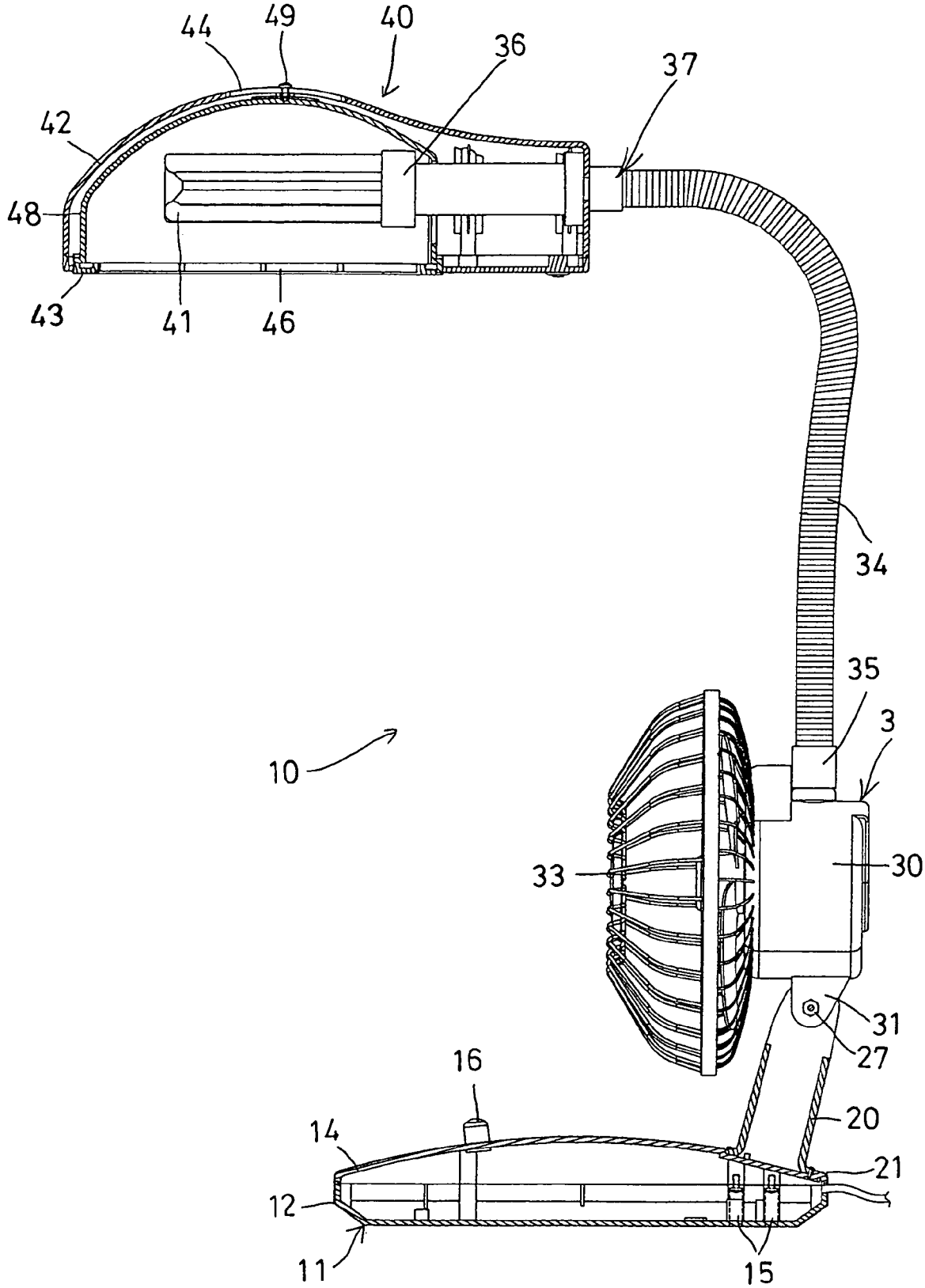
FIG. 3 is a partial cross sectional view of the light and fan device combination, taken along lines 3—3 of FIG. 2.

Referring to the drawings, and initially to FIGS. 1–3, a light and fan device combination 10 in accordance with the present invention comprises a base 11 including such as a lower receptacle 12 and an upper cover 14 secured together with such as fasteners 15, and including one or more switch buttons 16 provided thereon, such as provided on the upper cover 14, for actuating or controlling the light and fan device combination 10. The base 11 further includes a recess 18 formed in the upper portion thereof, such as formed in the upper portion of the upper cover 14.

A stand 20 includes a lower portion 21 engaged in the recess 18 of the base 11, and secured to the base 11 with such as fasteners 22, and includes a channel 23 formed in the upper portion of the stand 20 and defined between two flaps 24 each of which includes an orifice 25 formed therein, for receiving a fastener 26 and a lock nut 27. A fan device 3 includes a motor housing 30 having an extension 31 extended downwardly therefrom for rotatably securing to the stand 20 with the fastener 26.

For example, the extension 31 of the motor housing 30 may be rotatably engaged into the channel 23 of the stand 20 and retained between the flaps 24, and the fastener 26 may be engaged through the flaps 24 and the extension 31 of the motor housing 30, and may be threaded with the lock nut 27, for adjustably securing the motor housing 30 to the stand 20 at any selected angular direction. It is preferable that the fastener 26 is a wing screw or the like. The fan device 3 includes a fan member 33 attached to the motor housing 30, for being energized or operated to generate air streams or to circulate air.

A flexible extension 34 includes one end, such as lower end 35 attached or secured to the motor housing 30, and includes a socket 36 formed or provided on the other end 37, such as the upper end 37 thereof, for engaging with or for attaching a light member 41 of a light device 40 which may generate lights. The light device 40 includes an upper casing 42 and a lower casing 43 secured together, and attached onto the other end 37 of the flexible extension 34. The upper casing 42 includes one or more grooves 44 formed therein. The flexible extension 34 allows the light device 40 to be adjusted and directed toward any suitable or selected direction.

The lower casing 43 includes an opening 45 formed therein, and a net or screen 46 is engaged in the opening 45 of the lower casing 43, and secured to the lower casing 43 with such as fasteners (not shown), or by force-fitted engagements, and includes a number of perforations 47 formed therein, for allowing the light generated by the light member 41 of the light device 40 to emit out through the perforations 47 of the net or screen 46. The upper casing 42 may be formed into various kinds of shapes or configurations as shown in FIGS. 1–5 and 6 and 7 respectively.

A hood or a reflector 48 may further be loosely or slidably or adjustably received within the upper casing 42 or between the upper casing 42 and the lower casing 43, and a fastener 49 may be slidably engaged through one of the grooves 44 of the upper casing 42, and may be threaded or attached to the hood 48, for slightly moving or adjusting the hood or the reflector 48 relative to the upper casing 42 and/or the lower casing 43, and for such as adjusting the light beam reflected and/or generated by the light member 41 of the light device 40.

Figure 4:
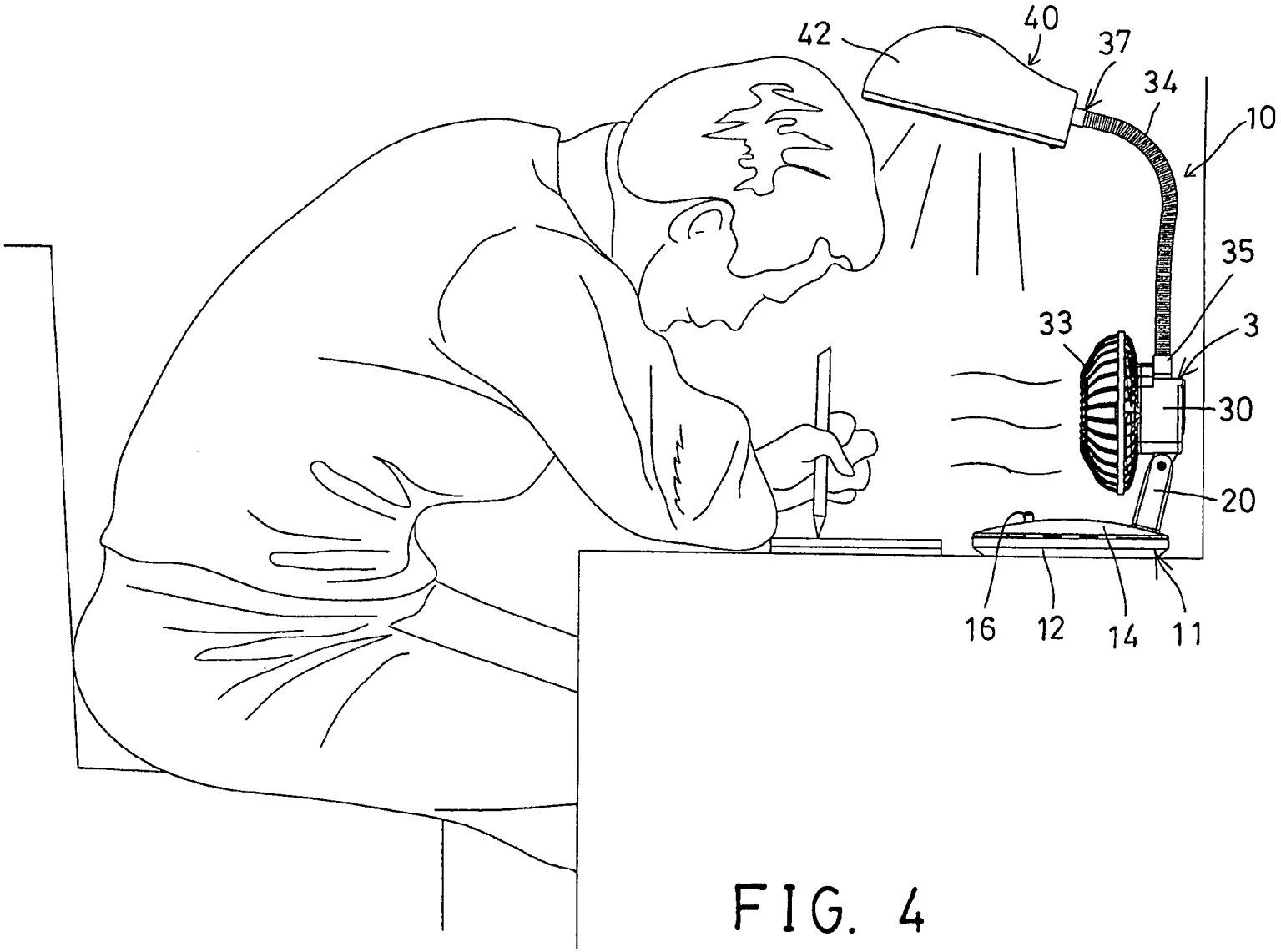
FIG. 4 is a side plan schematic view illustrating the operation of the light and fan device combination.
Figure 5:
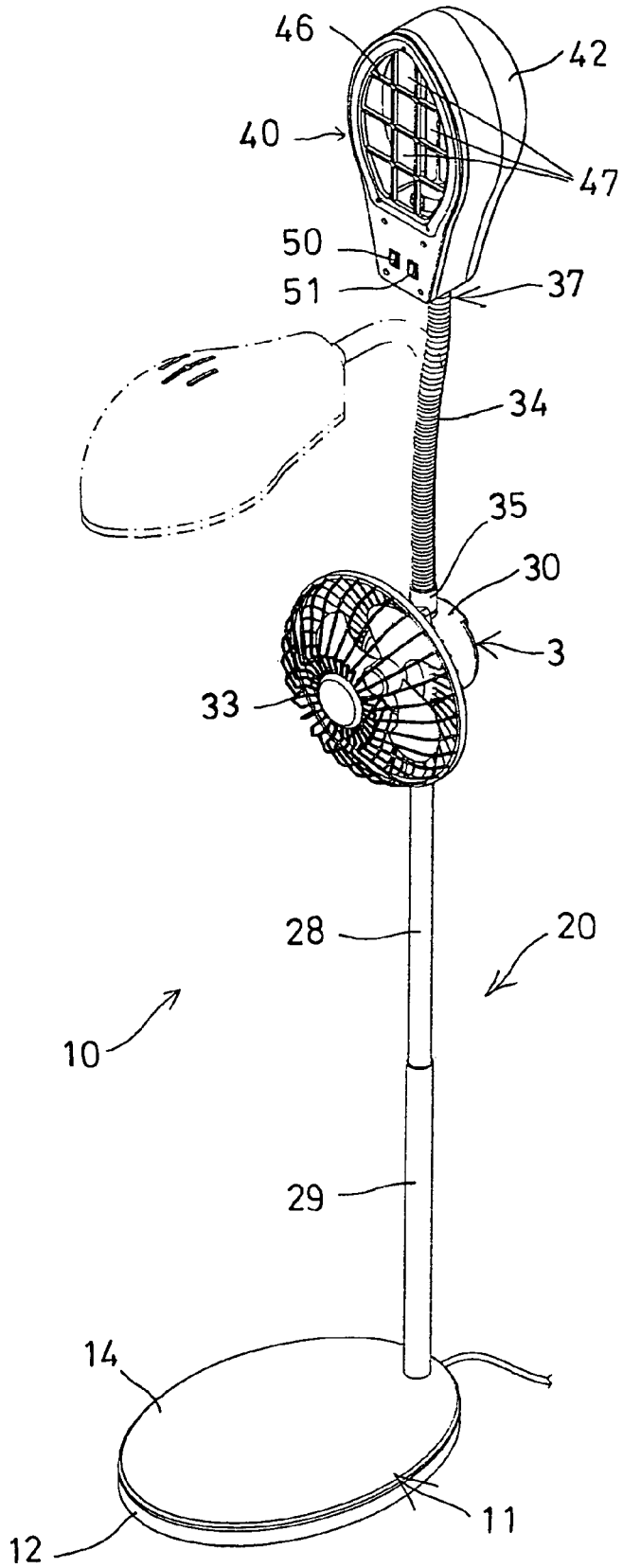
FIG. 5 is a perspective view similar to FIG. 2, illustrating the other arrangement of the light and fan device combination.
Figure 6:
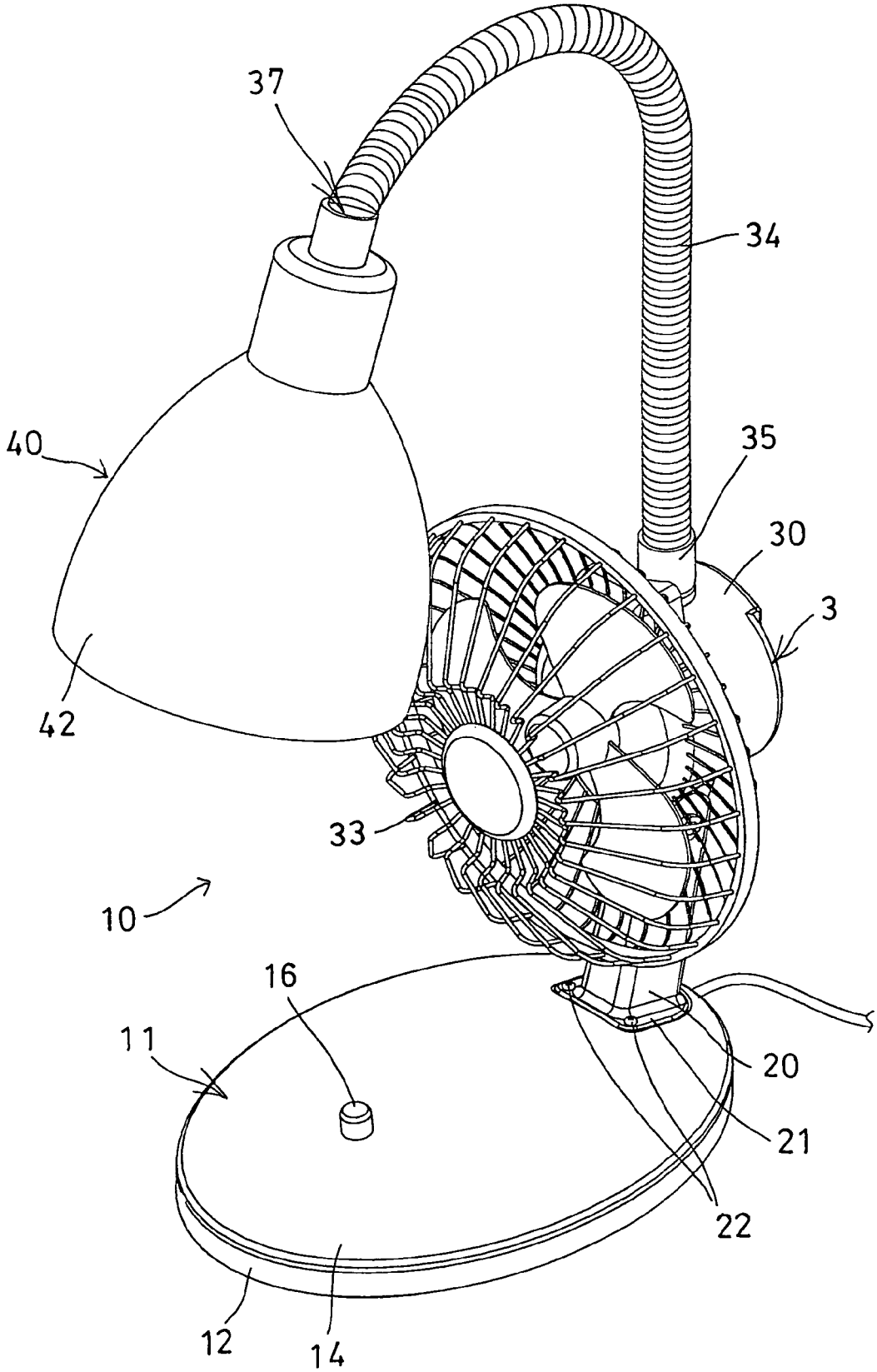
FIG. 6 is a perspective view similar to FIGS. 2 and 5, illustrating the further arrangement of the light and fan device combination.
Figure 7:
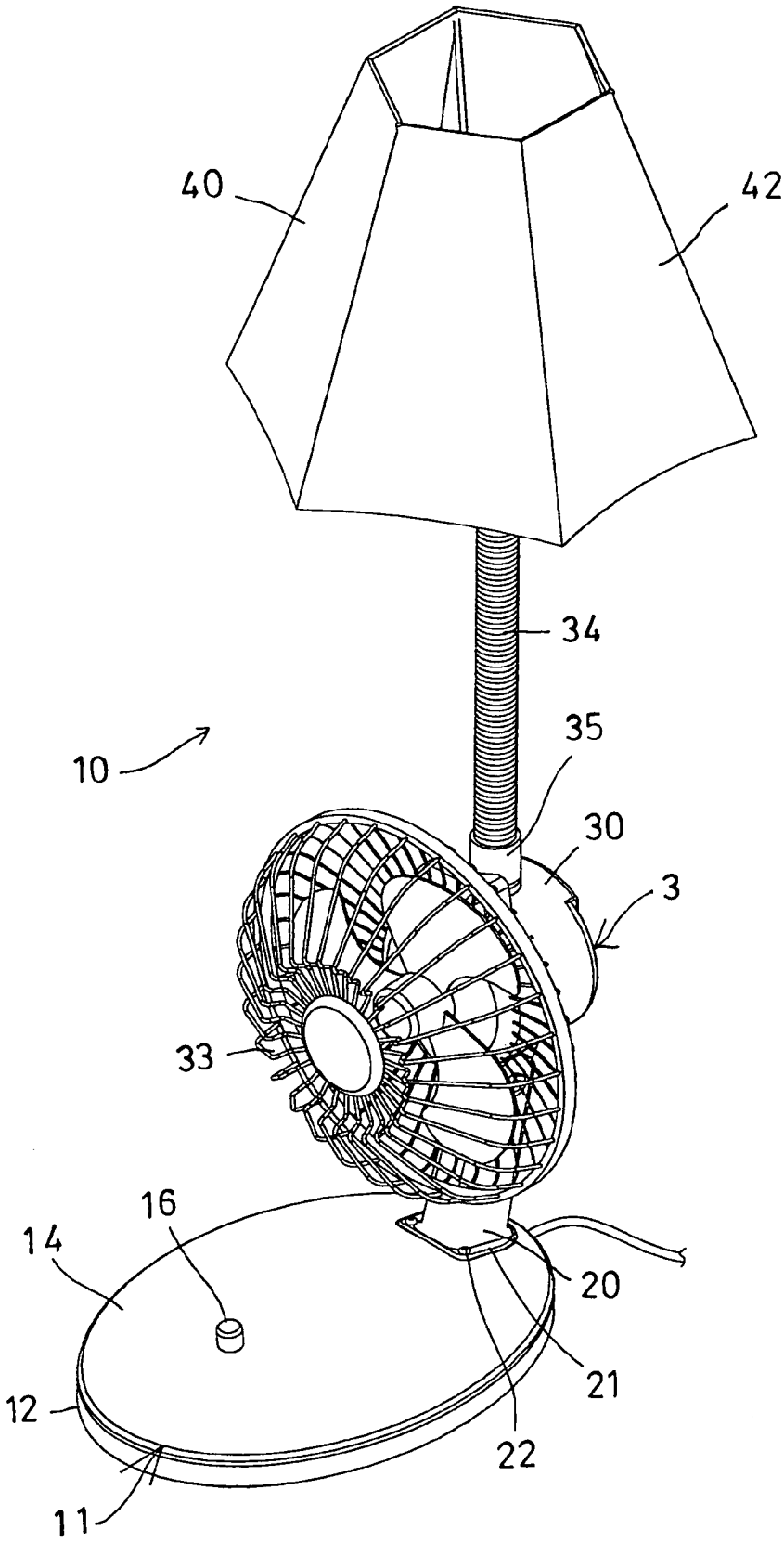
FIG. 7 is a perspective view similar to FIGS. 2, 5 and 6, illustrating the still further arrangement of the light and fan device combination.

As shown in FIG. 5, the light device 40 may include one or more switch buttons 50, 51 provided thereon, for actuating or controlling the fan device 3 and/or the light device 40 of the light and fan device combination 10. Similarly, the switch buttons 16 (FIGS. 1–4 and 6–7) may also be provided for actuating or controlling the fan device 3 and/or the light device 40 of the light and fan device combination 10. The stand 20 may include two or more tubes 28, 29 slidably or adjustably secured together to form an extendible or telescopic structure.

In operation, as shown in FIG. 4, the air streams generated by the fan device 3 will not blow or flow through the light member 41 of the light device 40, and thus will not blow the heat generated by the light member 41 of the light device 40 toward the users. In addition, the light device 40 may be adjusted and directed toward any suitable or selected direction by the flexible extension 34, and will not be affected by the fan device 3. Furthermore, the reflector 48 may be used to adjust the light beam reflected and/or generated by the light member 41 of the light device 40 relative to the upper casing 42 and/or the lower casing 43.

Accordingly, the light and fan device combination in accordance with the present invention includes a light device and a fan device separated from each other, for allowing the light device and the fan device to be operated properly, and for preventing the light device from being affected by the fan device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light and fan device combination comprising:

a base, a stand disposed on said base, a fan device disposed on top of said stand, for generating air streams, said fan device including a motor housing having an extension extended downwardly therefrom for rotatably securing to said stand, an extension attached to said fan device, and a light device attached to said extension, for generating lights, and said stand including a channel formed therein and defined between two flaps each of which includes an orifice formed therein, for rotatably receiving said extension of said motor housing, and a fastener engaged through said flaps and said extension of said motor housing, and threaded with a lock nut, for adjustably securing said motor housing to said stand at any selected angular direction.

2. A light and fan device combination comprising:

a base including a recess formed therein, a stand disposed on said base, said stand including a lower portion engaged in said recess of said base, and secured to said base with at least one fastener, a fan device disposed on top of said stand, for generating air streams, said fan device including a motor housing having an extension extended downwardly therefrom for rotatably securing to said stand, an extension attached to said fan device, and a light device attached to said extension, for generating lights.

3. The light and fan device combination as claimed in claim 2, wherein said extension is a flexible extension.

4. The light and fan device combination as claimed in claim 1, wherein said extension includes a socket provided thereon, and said light device includes a light member attached to said socket.

5. The light and fan device combination as claimed in claim 2, wherein said light device includes a lower casing secured to an upper casing and attached onto said extension.

6. The light and fan device combination as claimed in claim 2, wherein said lower casing includes an opening formed therein, and a screen engaged in said opening and secured to said lower casing and having a plurality of perforations formed therein, for allowing the light generated by a light member of said light device to emit out through said perforations of said screen.

* * * * *